US010923843B1

(12) United States Patent
Henry et al.

(10) Patent No.: US 10,923,843 B1
(45) Date of Patent: Feb. 16, 2021

(54) RECEPTACLE ASSEMBLY HAVING CABLED RECEPTACLE CONNECTOR

(71) Applicant: TE Connectivity Services GmbH, Schaffhausen (CH)

(72) Inventors: Randall Robert Henry, Lebanon, PA (US); Brandon Michael Matthews, McAlisterville, PA (US); Michael John Phillips, Camp Hill, PA (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 0 days.

(21) Appl. No.: 16/811,788

(22) Filed: Mar. 6, 2020

(51) Int. Cl.
*H01R 12/75* (2011.01)
*H01R 12/71* (2011.01)

(52) U.S. Cl.
CPC ..... *H01R 12/75* (2013.01); *H01R 12/716* (2013.01)

(58) Field of Classification Search
CPC ..... H01R 12/75; H01R 12/716
See application file for complete search history.

(56) References Cited

U.S. PATENT DOCUMENTS

| | | | | |
|---|---|---|---|---|
| 10,367,294 | B1 * | 7/2019 | Smith | H01R 13/6592 |
| 10,777,936 | B2 * | 9/2020 | Smith | H01R 13/6592 |
| 2009/0269962 | A1 * | 10/2009 | Miller | H01R 13/6275 439/345 |
| 2016/0218455 | A1 * | 7/2016 | Sayre | H01R 13/6594 |
| 2020/0153163 | A1 * | 5/2020 | Guetig | H01R 13/6582 |
| 2020/0244025 | A1 * | 7/2020 | Winey | H01R 43/18 |
| 2020/0274267 | A1 * | 8/2020 | Zerebilov | H01R 13/502 |

* cited by examiner

*Primary Examiner* — Abdullah A Riyami
*Assistant Examiner* — Nader J Alhawamdeh

(57) ABSTRACT

A cabled receptacle connector includes a receptacle housing and a cable assembly received in the receptacle housing. The cable assembly includes a support frame supporting first and second mating contacts have mating ends for electrical connection with a pluggable module. The cable assembly includes cables with conductors electrically connected to the first mating contacts. The cable assembly includes jumper contacts coupled to the support frame electrically connected to the second mating contacts. The jumper contacts include mounting ends mounted to a host circuit board. First electrical paths are defined between the pluggable module and a remote electrical component by the first mating contacts and the cable conductors. Second electrical paths are defined between the pluggable module and the host circuit board by the second mating contacts and the jumper contacts.

20 Claims, 11 Drawing Sheets

RECEPTACLE ASSEMBLY HAVING CABLED RECEPTACLE CONNECTOR

BACKGROUND OF THE INVENTION

The subject matter herein relates generally to communication systems and receptacle assemblies for communication systems.

Communication systems are known to have receptacle assemblies mounted to host circuit boards. The communication systems typically include a board mounted receptacle connector mounted directly to the host circuit board within a receptacle cage. The receptacle connector has contacts including mating ends defining a mating interface for mating with pluggable modules and terminating ends that are terminated directly to the host circuit board. Signal paths are defined from the pluggable modules to the host circuit board through the signal contacts of the receptacle connectors. However, such receptacle assemblies are not without disadvantages. For example, the electrical signal paths through the host circuit board routed to another electrical component may be relatively long leading to problems with signal loss along the electrical signal paths. As such, some known communication systems utilize receptacle connectors having cables terminated to the signal contacts rather than terminating the signal contacts directly to a host circuit board. The cables transmit the signals from the pluggable module to the remote electrical component. However, the cables add cost to the system. Additionally, cable management may be an issue when a large number of cables are provided.

A need remains for a cost effective and reliable receptacle assembly for a communication system.

BRIEF DESCRIPTION OF THE INVENTION

In an embodiment, a cabled receptacle connector for a receptacle assembly is provided. The cabled receptacle connector includes a receptacle housing having a cavity extending between a front and a rear of the receptacle housing. The receptacle housing has a mating slot at the front configured to receive a pluggable module removably received in a receptacle cage of the receptacle assembly. The cabled receptacle connector includes a cable assembly received in the cavity at the rear of the receptacle housing. The cable assembly includes a support frame having a platform supporting first mating contacts and second mating contacts. The first mating contacts have first mating ends extending into the mating slot for electrical connection with the pluggable module. The second mating contacts have second mating ends extending into the mating slot for electrical connection with the pluggable module. The cable assembly includes cables coupled to the platform. The cables have conductors electrically connected to first terminating ends of the first mating contacts. The cables extend from the cable receptacle connector. The cable assembly includes jumper contacts coupled to the support frame. The jumper contacts are electrically connected to the second mating contacts. The jumper contacts include mounting ends configured to be mounted to a host circuit board. First electrical paths are defined between the pluggable module and an electrical component remote from the receptacle housing by the first mating contacts and the cable conductors. Second electrical paths are defined between the pluggable module and the host circuit board by the second mating contacts and the jumper contacts.

In another embodiment, a cabled receptacle connector for a receptacle assembly is provided. The cabled receptacle connector includes a receptacle housing having a top and a bottom. The receptacle housing has a cavity between the top and the bottom. The receptacle housing has a mating slot at a front configured to receive a pluggable module removably received in a receptacle cage of the receptacle assembly above a host circuit board. The cabled receptacle connector includes a cable assembly received in the cavity at the rear of the receptacle housing. The cable assembly includes cables having conductors. The cables extend rearward from the cable receptacle connector. The cable assembly includes a support frame having a platform supporting first mating contacts and second mating contacts. The first mating contacts have first mating ends and first terminating ends. The first mating ends extend into the mating slot for electrical connection with the pluggable module. The first terminating ends extend along the platform for electrical connection with the conductors of the cables. The second mating contacts have second mating ends extending into the mating slot for electrical connection with the pluggable module. The second mating contacts have jumper contacts opposite the mating ends. The jumper contacts are coupled to the support frame and extend to the bottom of the receptacle housing for electrical connection with the host circuit board. First electrical paths are defined between the pluggable module and an electrical component remote from the receptacle housing by the first mating contacts and the cable conductors. Second electrical paths are defined between the pluggable module and the host circuit board by the second mating contacts and the jumper contacts.

In a further embodiment, a receptacle assembly is provided. The receptacle assembly includes a receptacle cage having a plurality of walls defining a module channel extending between a front and a rear of the receptacle cage. The plurality of walls includes a top wall, a first side wall extending from the top wall to a bottom of the receptacle cage and a second side wall extending from the top wall to the bottom. The module channel is open at the front to receive a pluggable module therein. The module channel is open at the rear. The receptacle assembly includes a cabled receptacle connector received in the module channel at the rear of the receptacle cage. The cabled receptacle connector includes a receptacle housing coupled to the receptacle cage. The receptacle housing has a cavity extending between a front and a rear of the receptacle housing. The receptacle housing has a mating slot at the front configured to receive a pluggable module removably received in a receptacle cage of the receptacle assembly. The cabled receptacle connector includes a cable assembly received in the cavity at the rear of the receptacle housing. The cable assembly includes a support frame having a platform supporting first mating contacts and second mating contacts. The first mating contacts have first mating ends extending into the mating slot for electrical connection with the pluggable module. The second mating contacts have second mating ends extending into the mating slot for electrical connection with the pluggable module. The cable assembly includes cables coupled to the platform. The cables have conductors electrically connected to first terminating ends of the first mating contacts. The cables extend from the cable receptacle connector rearward of the receptacle cage. The cable assembly includes jumper contacts coupled to the support frame. The jumper contacts are electrically connected to the second mating contacts. The jumper contacts include mounting ends configured to be mounted to a host circuit board. First electrical paths are defined between the pluggable module and an electrical component remote from the receptacle housing by the first mating contacts and the cable conductors. Second electrical paths are defined between the pluggable module and the host circuit board by the second mating contacts and the jumper contacts.

DETAILED DESCRIPTION OF THE INVENTION

Various embodiments described herein include a receptacle cage for a receptacle assembly of a communication system, such as for an input/output (I/O) module. The receptacle cage may be configured for a quad small form-factor pluggable (QSFP), a small form-factor pluggable (SFP), an octal small form-factor pluggable (OSFP), and the like. In various embodiments, the receptacle cage includes an opening positioned at a rear of the receptacle cage to allow for a direct-attached, cabled receptacle connector to be loaded therein at the rear and an opening positioned at a front of the receptacle cage to receive a pluggable module for mating with the corresponding cabled receptacle connector. The cabled receptacle connector is mounted directly to the receptacle cage. The cabled receptacle connector in the receptacle cage is configured to be coupled directly to another component via the cable rather than being terminated to a host circuit board, as is common with conventional receptacle assemblies, which improves signal loss and improves skew by transmitting signals via the cable versus standard, board mounted receptacle connectors. In an exemplary embodiment, the high speed signals are transmitted via the cable, while the low speed, sideband signals are electrically connected to the host circuit board. Routing the sideband signals through the host circuit board rather than the cable reduces the number of signal lines in the cable, thus reducing the size and cost of the cable.

Figure 1:
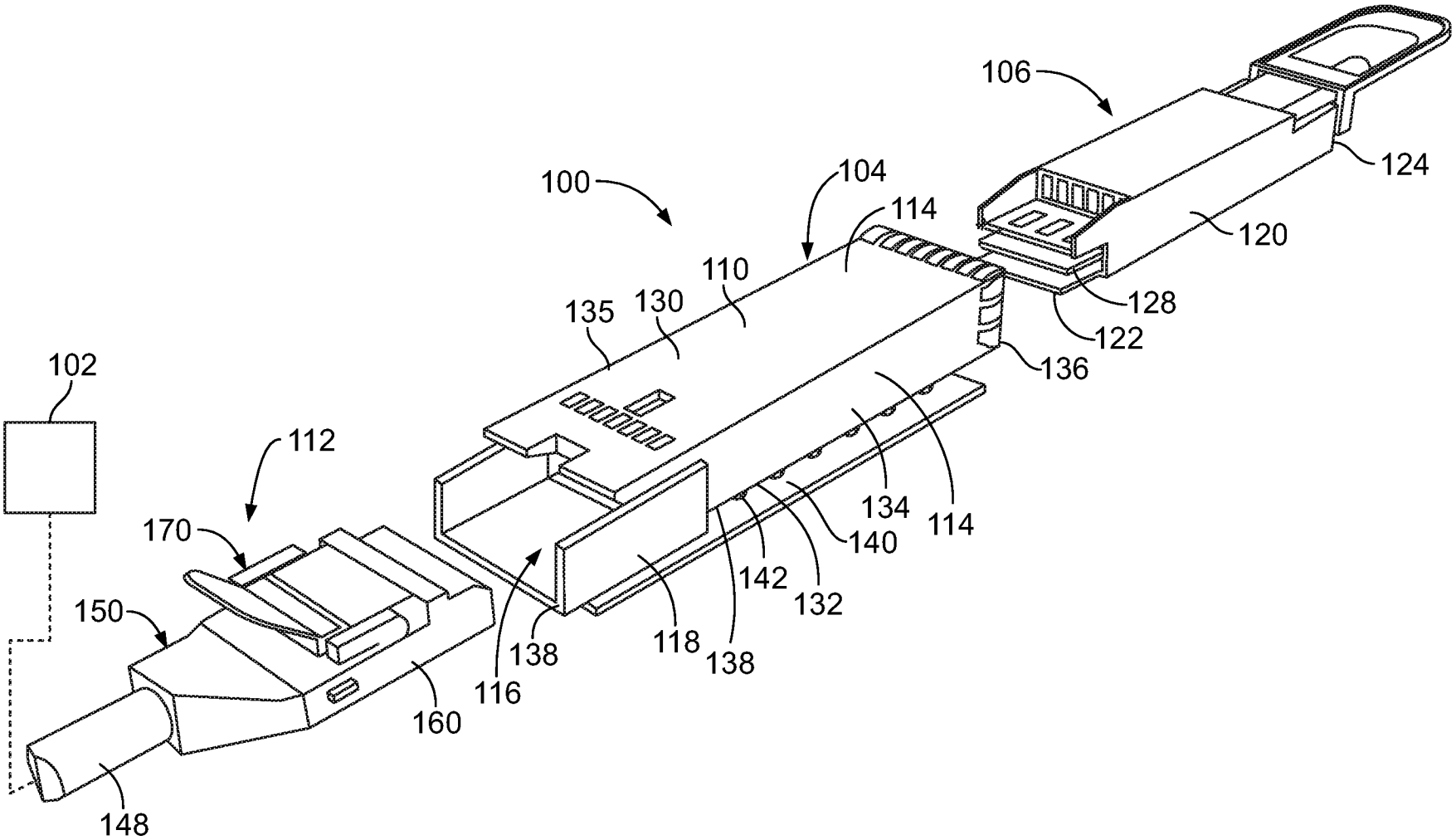
FIG. 1 is an exploded view of a communication system formed in accordance with an exemplary embodiment.
Figure 2:
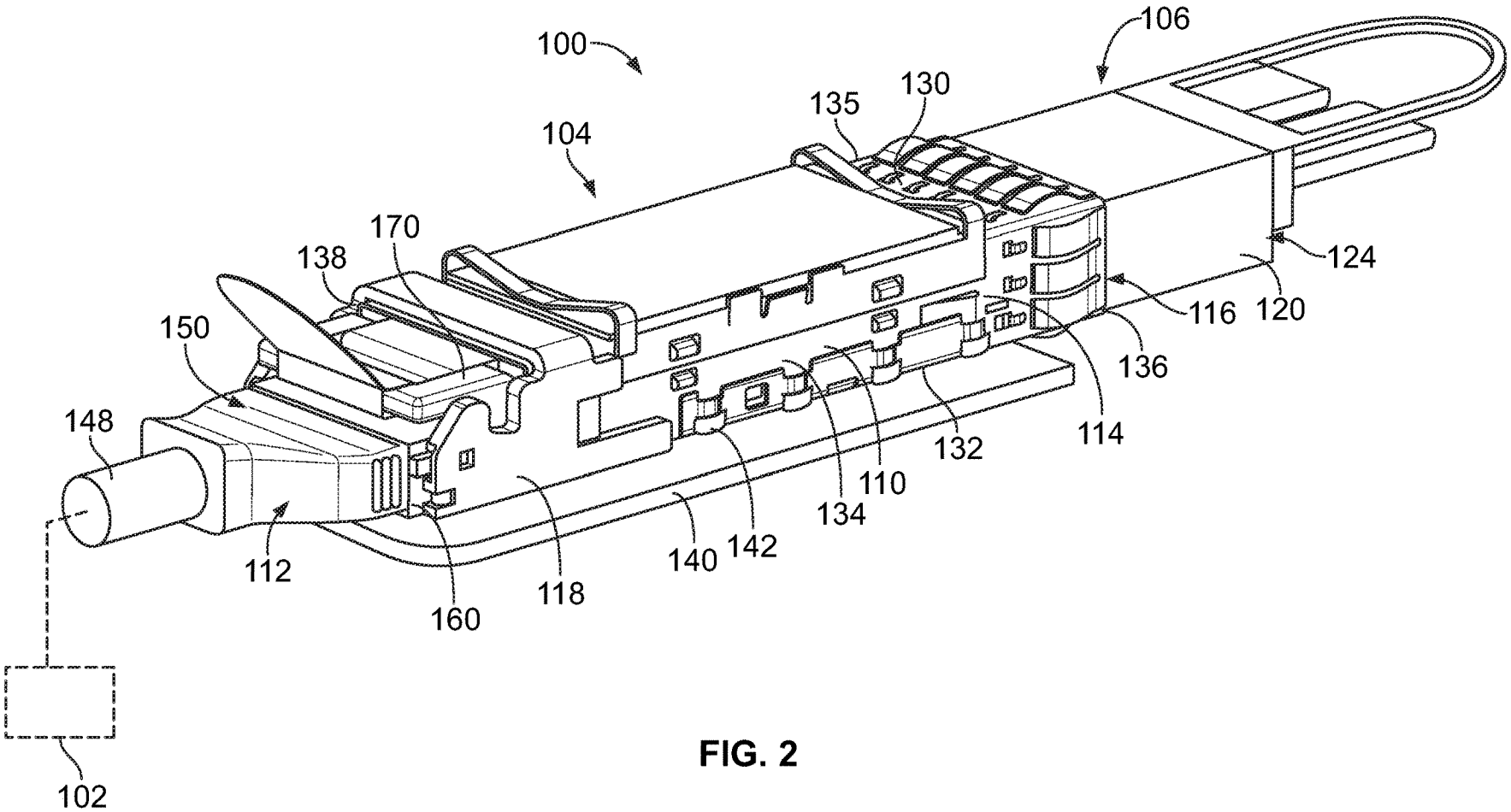
FIG. 2 is a rear perspective view of the communication system in an assembled state in accordance with an exemplary embodiment.

FIG. 1 is an exploded view of a communication system 100 formed in accordance with an exemplary embodiment. FIG. 2 is a rear perspective view of the communication system 100 in an assembled state. The communication system 100 includes an electrical component 102 and a receptacle assembly 104 electrically connected to the electrical component 102. The electrical component 102 may be located remote from the receptacle assembly 104, such as behind the receptacle assembly 104. The receptacle assembly 104 is electrically connected to the electrical component 102 via cables. A pluggable module 106 is configured to be electrically connected to the receptacle assembly 104. The pluggable module 106 is electrically connected to the electrical component 102 through the receptacle assembly 104. For example, the signals (e.g., the high speed signals) of the pluggable module 106 may be electrically connected to the electrical component 102 via cables rather than through conductive traces of a circuit board. In various embodiments, the receptacle assembly 104 may be mated with a plurality of pluggable modules 106 rather than a single pluggable module 106.

In an exemplary embodiment, the receptacle assembly 104 includes a receptacle cage 110 and a cabled receptacle connector 112 received in the receptacle cage 110 for mating with the corresponding pluggable module 106. Optionally, a portion of the cabled receptacle connector 112 may extend from or be located rearward of the receptacle cage 110. In various embodiments, the receptacle assembly 104 may include a plurality of cabled receptacle connectors 112 within the receptacle cage 110 rather than a single cabled receptacle connector 112. The cabled receptacle connectors 112 may be stacked or may be arranged side-by-side within an appropriate receptacle cage 110.

In various embodiments, the receptacle cage 110 is enclosed and provides electrical shielding for the cabled receptacle connector 112. The pluggable module 106 is loaded into the front of the receptacle cage 110 and is at least partially surrounded by the receptacle cage 110. In an exemplary embodiment, the receptacle cage 110 includes a shielding, stamped and formed cage member that includes a plurality of shielding walls 114 that define a module channel 116 that receives the pluggable module 106 and the cabled receptacle connector 112. In an exemplary embodiment, the receptacle cage 110 includes a guide 118 at the rear for positioning and/or securing the cabled receptacle connector 112 in the receptacle cage 110. In various embodiments, the guide 118 is separate and discrete from the shielding walls 114 defining the receptacle cage 110 and coupled thereto, such as at a rear of the receptacle cage 110. In other various embodiments, the guide 118 may be integral with the receptacle cage 110, such as being defined by the shielding walls 114, such that the cabled receptacle connector 112 is mated directly to the shielding walls 114 of the receptacle cage 110.

As shown in FIG. 1, the pluggable module 106 has a pluggable body 120, which may be defined by one or more shells. The pluggable body 120 may be thermally conductive and/or may be electrically conductive, such as to provide EMI shielding for the pluggable module 106. The pluggable body 120 includes a mating end 122 and an opposite front end 124. The mating end 122 is configured to be inserted into the module channel 116. The front end 124 may be a cable end having a cable extending therefrom to another component within the system.

The pluggable module 106 includes a module circuit board 128 that is configured to be communicatively coupled to the cabled receptacle connector 112. The module circuit board 128 may be accessible at the mating end 122. The module circuit board 128 may include components, circuits and the like used for operating and or using the pluggable module 106. For example, the module circuit board 128 may have conductors, traces, pads, electronics, sensors, controllers, switches, inputs, outputs, and the like associated with the module circuit board 128, which may be mounted to the module circuit board 128, to form various circuits.

In an exemplary embodiment, the walls 114 of the receptacle cage 110 include a top wall 130, a bottom wall 132, a first side wall 134 and a second side wall 135. The first and second side walls 134, 135 extend from the top wall 130 to the bottom wall 132. The walls 114 extend between a front 136 and a rear 138 of the receptacle cage 110. In various embodiments, the receptacle cage 110 is configured to be mounted to a component, such as a chassis, substrate or circuit board. For example, the bottom of the receptacle cage 110 may be mounted to the component. In the illustrated embodiment, the component is a host circuit board 140. The receptacle cage 110 may be electrically connected to the host circuit board 140, such as being press fit into plated vias of the host circuit board 140. For example, the side walls 134, 135 may include mounting features 142, such as compliant pins, used to mount the receptacle cage 110 to the host circuit board 140.

In an exemplary embodiment, the receptacle cage 110 may include one or more gaskets at a front 136 of the receptacle cage 110. The gaskets may be configured to electrically connect the pluggable module 106 with the receptacle cage 110 and/or to electrically connect the receptacle cage 110 to a panel or a bezel. For example, the receptacle cage 110 may be received in a bezel opening of a bezel and the gasket may electrically connect to the bezel within the bezel opening. In other various embodiments, the pluggable body 120 of the pluggable module 106 may include one or more gaskets surrounding the outer perimeter of the pluggable module 106, such as proximate to the front end 124 and/or the mating end 122.

In an exemplary embodiment, the receptacle assembly 104 may include one or more heat sinks (not shown) for dissipating heat from the pluggable module 106. For example, the heat sink may be coupled to the top wall 130 for engaging the pluggable module 106. The heat sink may extend through an opening in the top wall 130 to directly engage the pluggable module 106. Other types of heat sinks may be provided in alternative embodiments.

In an exemplary embodiment, the cabled receptacle connector 112 is received in the receptacle cage 110, such as at a rear 138 of the receptacle cage 110. The rear 138 is open to receive the cabled receptacle connector 112. The cabled receptacle connector 112 is positioned in the module channel 116 to interface with the pluggable module 106 when loaded therein. In an exemplary embodiment, the cabled receptacle connector 112 is received in the receptacle cage 110. The pluggable module 106 is loaded through the front 136 to mate with the cabled receptacle connector 112. The shielding walls 114 of the receptacle cage 110 provide electrical shielding around the cabled receptacle connector 112 and the pluggable modules 106, such as around the mating interfaces between the cabled receptacle connector 112 and the pluggable modules 106. The cabled receptacle connector 112 is electrically connected to the electrical component 102 via one or more cables 148, such as arranged in a cable bundle within a common cable jacket. The cables 148 extend rearward from the cabled receptacle connector 112. The cables 148 are routed to the electrical component 102, such as behind the receptacle cage 110.

The cabled receptacle connector 112 includes a cable assembly 150 including mating contacts 152 (shown in FIG. 4) terminated to the cables 148. The cabled receptacle connector 112 includes a receptacle housing 160 that receives the cable assembly 150. The cabled receptacle connector 112 includes a latch 170 coupled to the receptacle housing 160.

Figure 3:
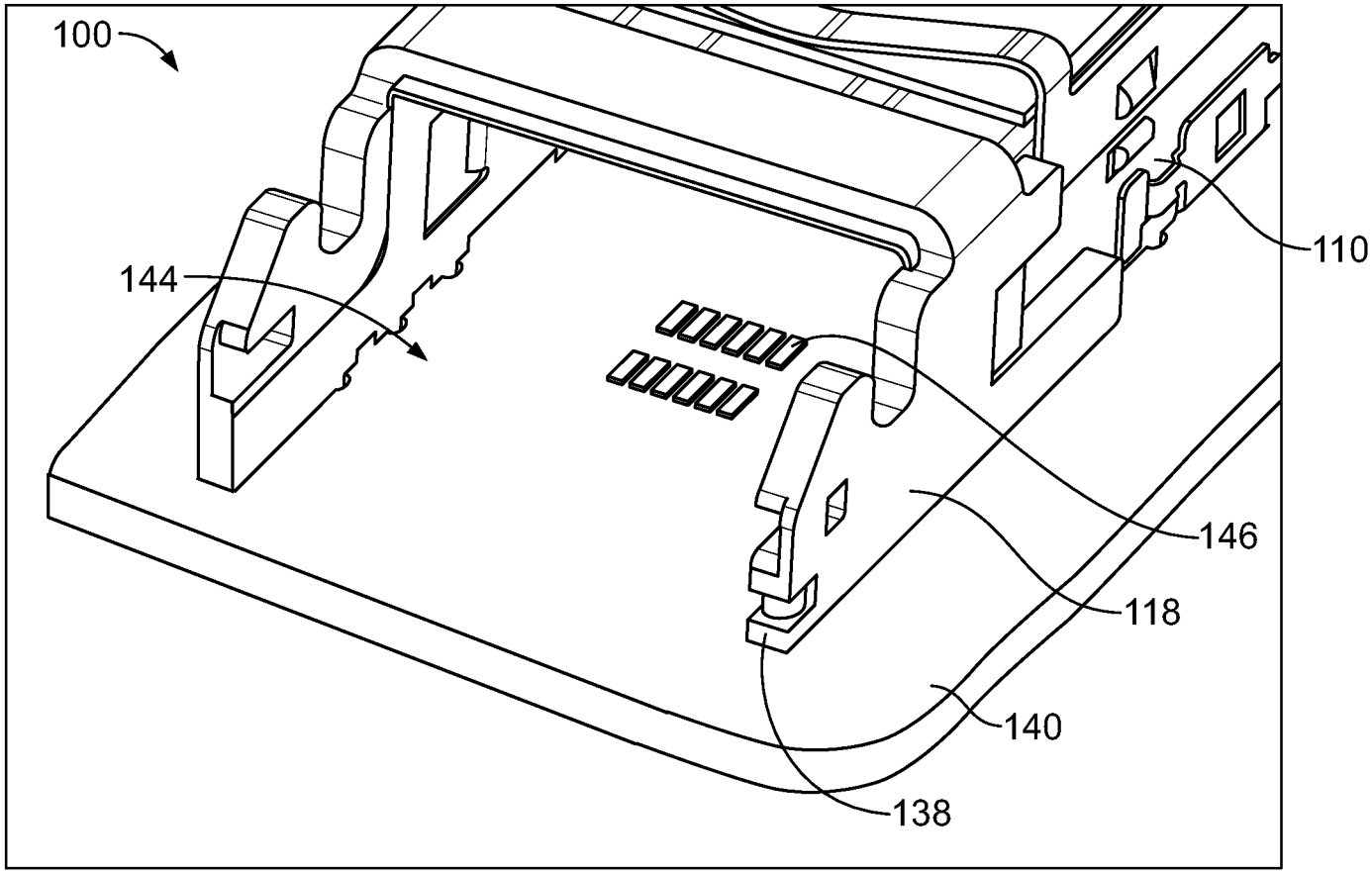
FIG. 3 is a top perspective view of a portion of the communication system showing a cable receptacle connector in accordance with an exemplary embodiment.

FIG. 3 is a top perspective view of a portion of the communication system 100 showing the cable receptacle connector 112 poised for mating with the receptacle cage 110. The receptacle cage 110 is mounted to the host circuit board 140 at a mounting area 144. The host circuit board 140 includes board contacts 146 within the mounting area 144. The board contacts 146 may be arranged in multiple rows, such as a first row and a second row. The cable receptacle connector 112 is configured to be electrically connected to the board contacts 146 when the cabled receptacle connector 112 is plugged into the rear 138 of the receptacle cage 110. In an exemplary embodiment, the low speed, sideband signals are configured to be electrically connected to the board contacts 146 such that the low speed, sideband signals are transmitted directly into the host circuit board 140, rather than being transmitted along the cables 148. The cable receptacle connector 112 includes contacts that are configured to interface with the board contacts 146 at a separable mating interface and are configured to be electrically connected to the pluggable module 106.

Figure 4:
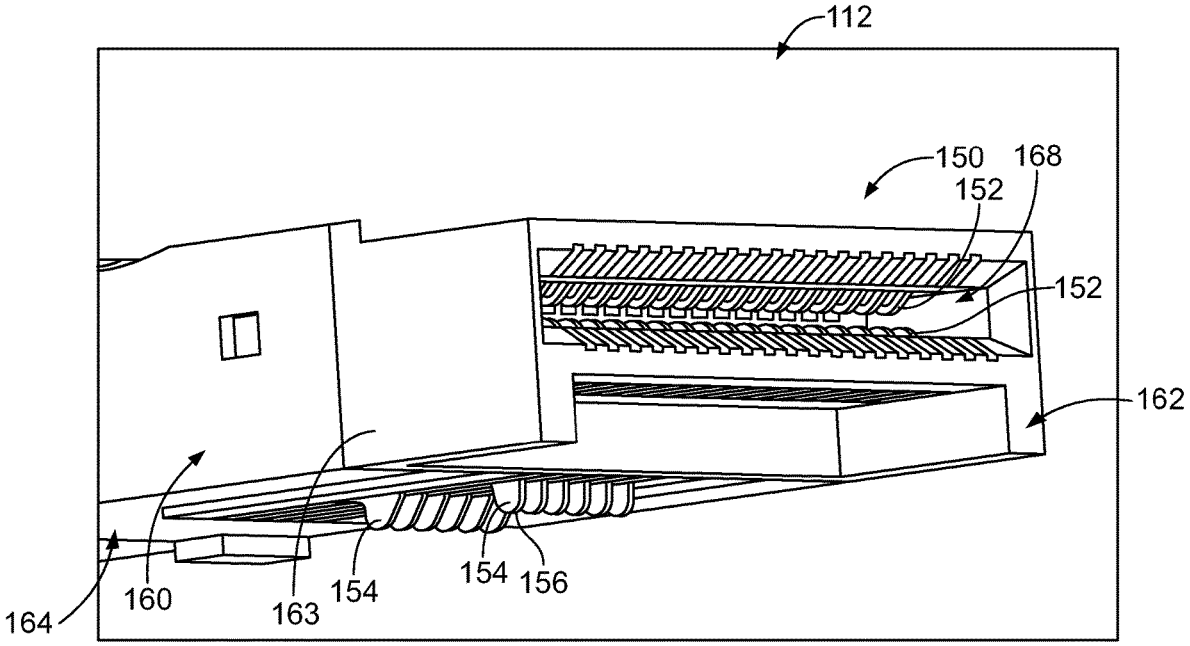
FIG. 4 is a front perspective view of a portion of the cable receptacle connector in accordance with an exemplary embodiment.

FIG. 4 is a front perspective view of a portion of the cable receptacle connector 112 in accordance with an exemplary embodiment. The cabled receptacle connector 112 includes the receptacle housing 160. The receptacle housing 160 extends between a mating end 162 and a cable end 164. Optionally, the receptacle housing 160 may be a multi-piece housing, such as including a front housing 163 at the mating end 162 coupled to a main housing body 165. In alternative embodiments, the receptacle housing 160 may be a single-piece housing. The receptacle housing 160 has a cavity extending between the mating end 162 and the cable end 164. The cavity receives the cable assembly 150. The housing 160 holds the mating contacts 152 of the cable assembly 150. In an exemplary embodiment, the cavity may extend to a card slot or mating slot 168 at the front of the housing 160 configured to receive part of the pluggable module 106 (FIG. 1), such as the module circuit board 128 (FIG. 1). The mating contacts 152 are configured to be positioned in the mating slot 168 for interfacing with the module circuit board 128. In an exemplary embodiment, the mating contacts 152 are arranged in an upper contact array of upper contacts for mating with an upper surface of the module circuit board 128 and in a lower contact array of lower contacts for mating with a lower surface of the module circuit board 128.

In an exemplary embodiment, the cabled receptacle connector 112 includes jumper contacts 154 extending from the receptacle housing 160 for electrical connection with the host circuit board 140 (shown in FIG. 3). The jumper contacts 154 are configured to be electrically connected to corresponding board contacts 146 (shown in FIG. 3). For example, the jumper contacts 154 extend from the bottom of the receptacle housing 160 for mating with the board contacts 146 at separable mating interfaces 156. The jumper contacts 154 may be spring biased against the board contacts 146 of the host circuit board 140 to maintain electrical connection with the board contacts 146. The jumper contacts 154 are electrically connected to corresponding mating contacts 152 for electrical connection with the module circuit board 128. The jumper contacts 154 are configured to transmit sideband signals between the host circuit board 140 and the module circuit board 128.

Figure 5:
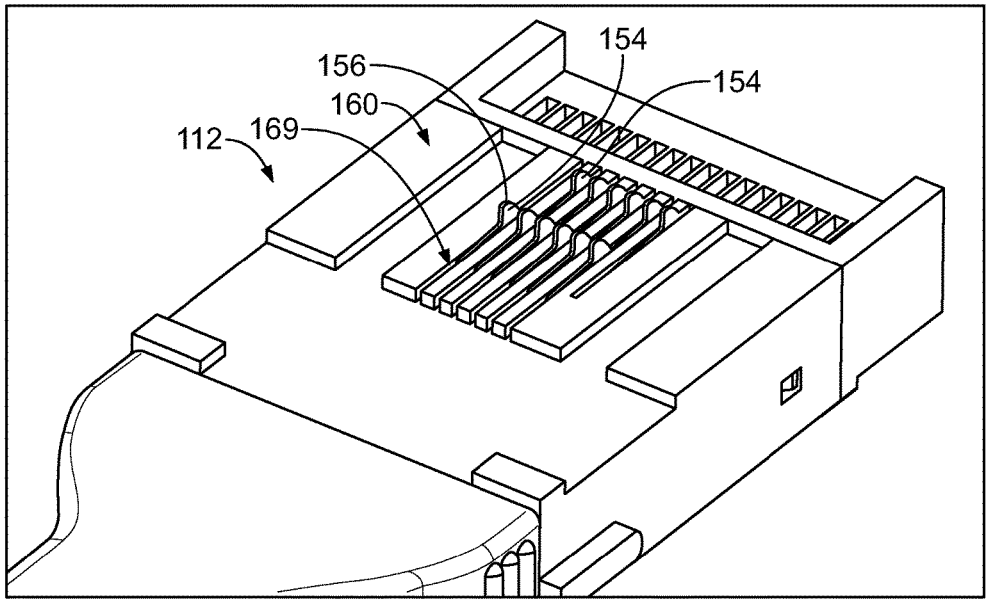
FIG. 5 is a bottom perspective view of the cabled receptacle connector in accordance with an exemplary embodiment.

FIG. 5 is a bottom perspective view of the cabled receptacle connector 112 in accordance with an exemplary embodiment. FIG. 5 illustrates the jumper contacts 154 extending from the bottom of the receptacle housing 160 for mating with the board contacts 146 at the separable mating interfaces 156. The receptacle housing 160 may include contact slots 169 at the bottom that receive corresponding jumper contacts 154.

Figure 6:
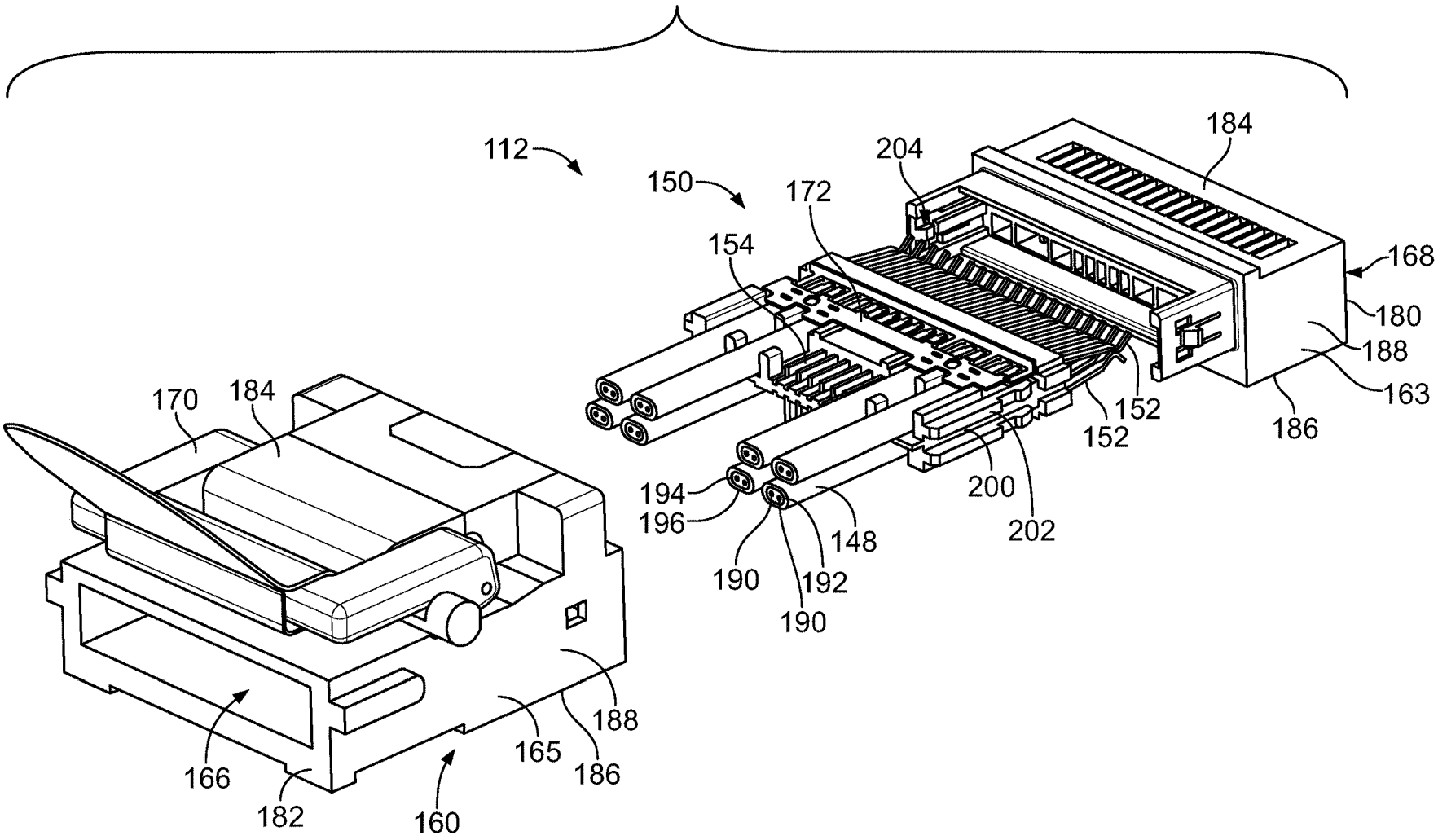
FIG. 6 is an exploded view of the cabled receptacle connector in accordance with an exemplary embodiment.

FIG. 6 is an exploded view of the cabled receptacle connector 112 in accordance with an exemplary embodiment. The cabled receptacle connector 112 includes the main housing body 165, the front housing 163, the cable assembly 150 and the latch 170. The front housing 163 is provided at a front 180 of the receptacle housing 160. The main housing body 165 is provided at a rear 182 of the receptacle housing 160. The receptacle housing 160 extends between a top 184 and a bottom 186. The receptacle housing 160 includes side walls 188 extending between the top 184 and the bottom 186. The side walls 188 may be defined by the main housing body 165 and/or the front housing 163. The cavity 166 is defined by the side walls 188, the top 184 and the bottom 186.

The cable assembly 150 is configured to be received in the cavity 166 such that the cables 148 extend rearward from the rear 182 of the receptacle housing 160. The mating contacts 152 of the cable assembly 150 are configured to be received in the front housing 163, such as in the mating slot 168 at the front 180 of the receptacle housing 160. The jumper contacts 154 are configured to extend through the main housing body 165 and/or the front housing 163 for interfacing with the host circuit board 140 (shown in FIG. 3), such as at the bottom 186.

The cables 148 are electrically connected to corresponding mating contacts 152. Optionally, the mating contacts 152 may be arranged in upper and lower contact arrays and the cables 148 are configured to be terminated to corresponding mating contacts 152 in the upper and lower contact arrays. The mating contacts 152 may include high speed contacts, low speed, side band contacts, and ground contacts. In various embodiments, the mating contacts 152 may include power contacts. Optionally, the cable assembly 150 may include a ground plate 172 used to electrically connect or common the ground contacts. The ground plate 172 may be electrically connected to the cables 148 to electrically common shields of the cables 148.

The cables 148 include conductors 190 terminated to the mating contacts 152. The conductors 190 may be soldered to the mating contacts 152 in various embodiments; however, the conductors 190 may be terminated by other means or processes in alternative embodiments, such as being crimped, insulation displacement connected, or by other processes. In an exemplary embodiment, the cables 148 are twin axial cables each having a pair of conductors 190, which may be electrically connected to a corresponding differential pair of the mating contact 152. The cables 148 may be unshielded or may be shielded, such as by an outer braid forming a cable shield 192 surrounding an insulator 194. The cables 148 may have a cable jacket 196 surrounding the cable shield 192 and the conductor(s) 190.

The cable assembly 150 includes a support frame 200 supporting the mating contacts 152 and the cables 148. The support frame 200 may be a dielectric frame, such as being manufactured by a plastic material. The support frame 200 may be a molded part. The mating contacts 152 extend forward from the support frame 200. The cables 148 extend rearward from the support frame 200. The support frame 200 may position the mating contacts 152 and/or the conductors 190 for termination therebetween. For example, the support frame 200 may hold the conductors 190 and allow the mating contacts 152 to be positioned relative to the conductors 190 for soldering therebetween. The support frame 200 may include features for locating the conductors 190 and/or the cable jackets 196 and/or the mating contacts 152. In an exemplary embodiment, the support frame 200 supports the jumper contacts 154 for electrical connection to the mating contacts 152. The support frame 200 may include guide features 202 to guide loading of the cable assembly 150 into the front housing 163 and/or the main housing body 165. For example, the guide features 202 may include rails, grooves, posts, tabs, pockets, and the like configured to interface with complimentary guide features 204 of the front housing 163 and/or the main housing body 165.

Figure 7:
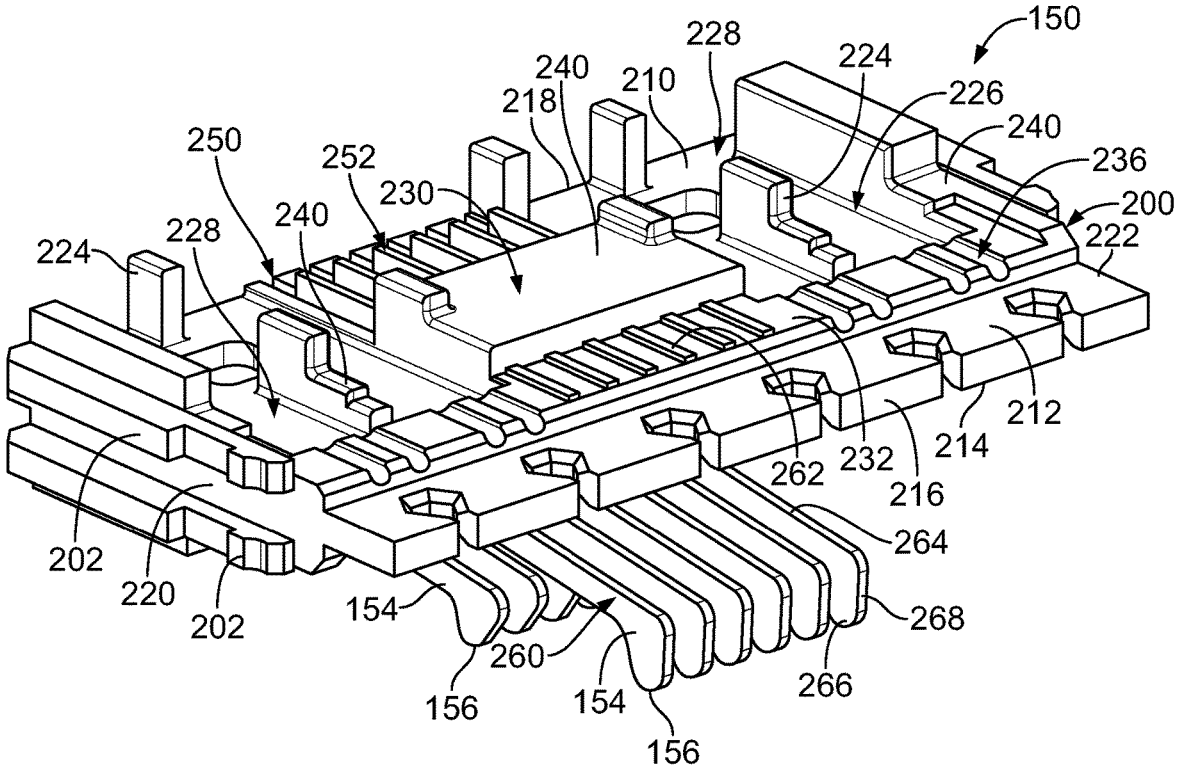
FIG. 7 is a top perspective view of a portion of a cable assembly of the cable receptacle connector in accordance with an exemplary embodiment.
Figure 8:
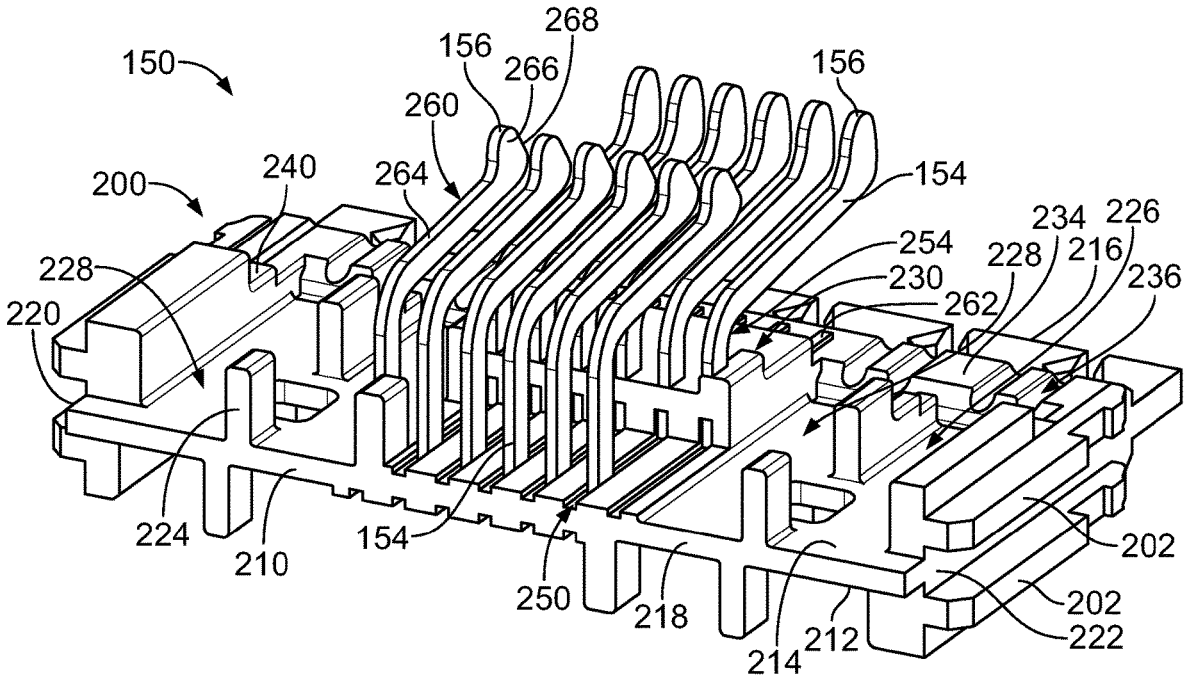
FIG. 8 is a bottom perspective view of a portion of the cable assembly in accordance with an exemplary embodiment.

FIG. 7 is a top perspective view of a portion of the cable assembly 150 showing the support frame 200 and the jumper contacts 154 in accordance with an exemplary embodiment. FIG. 8 is a bottom perspective view of a portion of the cable assembly 150 showing the support frame 200 and the jumper contacts 154 in accordance with an exemplary embodiment. The support frame 200 includes a platform 210 having an upper surface 212 and a lower surface 214. The platform 210 extends between a front edge 216 and a rear edge 218. The guide features 202 are provided along sides 220, 222 of the support frame 200.

In an exemplary embodiment, the support frame 200 includes cable walls 224 defining cable channels 226 configured to receive corresponding cables 148 (shown in FIG. 6). The cable walls 224 may be used for positioning the cables 148 relative to each other and relative to the support frame 200. The cable walls 224 may separate adjacent cables 148 from each other and control spacing between the cables 148. The cable channels 226 may be provided along both the upper surface 212 and the lower surface 214 for receiving cables 148 both above and below the platform 210. In an exemplary embodiment, the cable channels 226 are located in designated cable sections 228 near the first side 220 and near the second side 222, being separated by a central section 230. The central section 230 holds the jumper contacts 154. Other arrangements are possible in alternative embodiments for positioning the jumper contacts 154 and the cable channels 226.

The support frame 200 includes an upper shelf 232 at the upper surface 212 and a lower shelf 234 at the lower surface 214. The shelves 232, 234 are located forward of the cable channels 226. The shelves 232, 234 are used to support the conductors 190 and/or the mating contacts 152. In an exemplary embodiment, the shelves 232, 234 include slots 236 that receive the conductors 190 and/o the mating contacts 152. The slots 236 are used to control positions of the conductors 190 and/or the mating contacts 152 relative to other conductors 190 and/or mating contacts 152. In the illustrated embodiment, the slots 236 are radiused or curved to receive the conductors 190. The slots 236 may have other shapes in alternative embodiments.

In an exemplary embodiment, the support frame 200 includes ground plate supports 240 for supporting the ground plate 172 (shown in FIG. 6). The ground plate supports 240 extend from the upper surface 212 and the lower surface 214 to hold the ground plate 172 at an elevated position. The ground plate supports 240 may be provided at the sides and/or at the middle of the support frame 200. For example, in the illustrated embodiment, the support frame 200 includes a central ground plate supports, right ground plate supports and left ground plate supports.

The support frame 200 includes jumper contact channels 250 that receive corresponding jumper contacts 154. The jumper contacts 154 may be loaded (for example, stitched) into the jumper contact channels 250. In alternative embodiments, the support frame 200 may be molded around the jumper contacts 154. The jumper contacts 154 extend from the support frame 200, such as from the lower surface 214 for electrical connection with the host circuit board 140 (shown in FIG. 3). The jumper contacts 154 are exposed along the platform 210 for termination to the mating contacts 152.

In an exemplary embodiment, the jumper contacts 154 are arranged in sets, such as an upper set 252 of jumper contacts 154 and a lower set 254 of jumper contacts 154. The jumper contacts 154 of the upper set 252 extend to the upper surface 212 and the jumper contacts 154 of the lower set 254 extend to the lower surface 214. Each jumper contact 154 extends between a jumper mounting end 260 and a jumper terminating end 262. The jumper terminating end 262 is provided at the platform 210 (for example, at the upper surface 212 or the lower surface 214) for mating with the corresponding mating contact 152. In an exemplary embodiment, the jumper terminating ends 262 of the first set of jumper contacts 154 are located along the upper surface 212 of the platform 210 and the jumper terminating ends 262 of the second set of jumper contacts 154 are located along the lower surface 214 of the platform 210. The jumper terminating ends 262 may be provided at the shelves 232, 234, such as generally coplanar with the conductors 190 when held in the slots 236 for termination to the mating contacts 152. For example, upper edges of the upper jumper contacts 154 may be exposed at or above the upper shelf 232 and lower edges of the lower jumper contacts 154 may be exposed at or above the lower shelf 234.

The jumper mounting end 260 extends from the bottom of the support frame 200 to the separable mating interface 156. The jumper mounting end 260 is configured to be terminated to the corresponding board contact 146 of the host circuit board 140. The jumper mounting end 260 of the jumper contact 154 may include a beam 264 cantilevered from the support frame 200. The beam 264 may be bent or curved under the platform 210, such as in a forward direction (however the beams 264 may be bent in other directions and various beams 264 may be bent in different directions). The beams 264 are deflectable. For example, the beams 264 may be elastically deformed during mating with the board contacts 146 such that the jumper contacts 154 are spring biased against the board contacts 146. Optionally, the jumper contacts 154 may include fingers 266 at distal ends 268 of the beams 264. The fingers 266 extend downward and define the separable mating interfaces 156. The jumper mounting ends 260 of the first set of jumper contacts 154 are arranged in a first row and the jumper mounting ends 260 of the second set of jumper contacts 154 are arranged in a second row offset from the first row.

Figure 9:
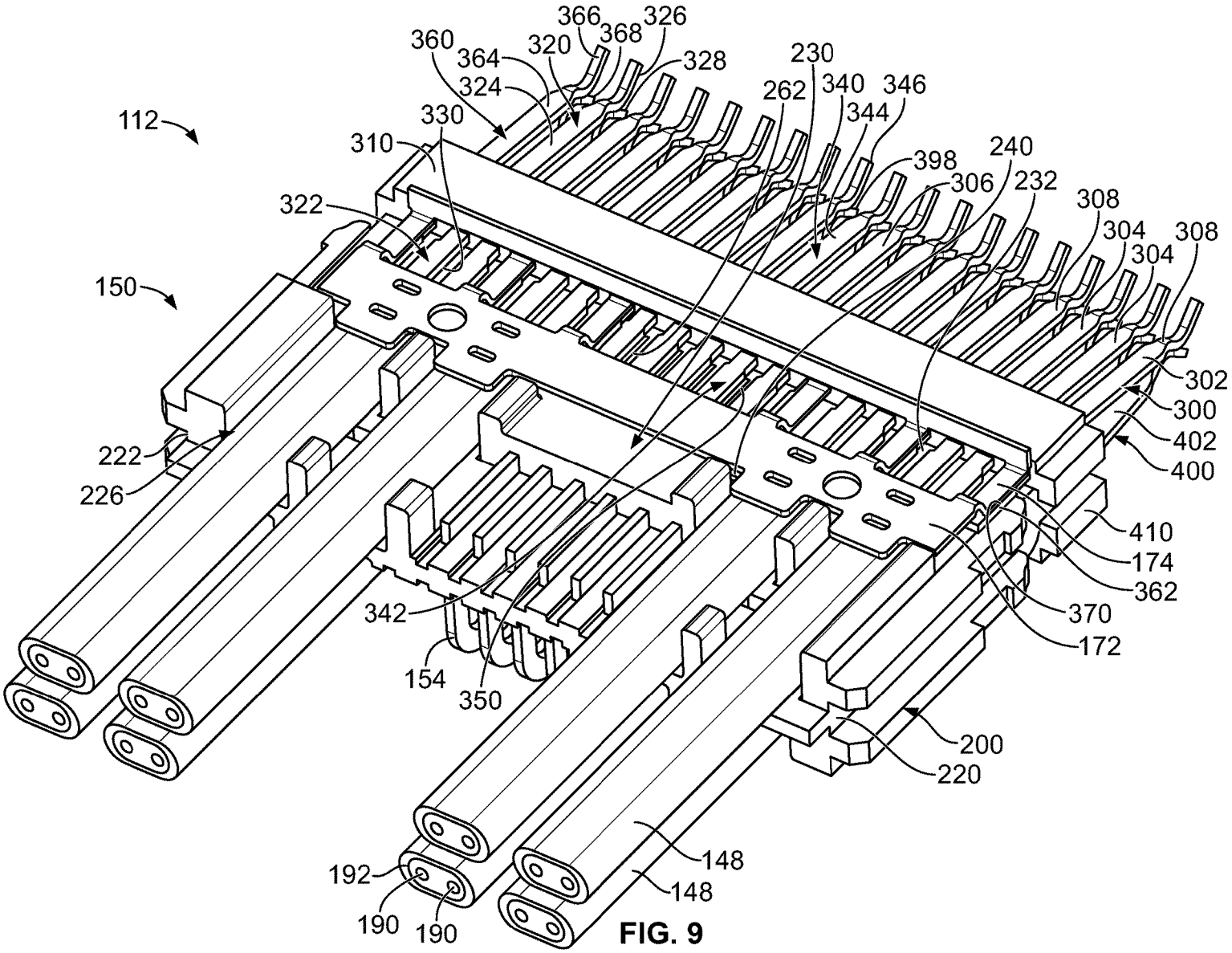
FIG. 9 is a top perspective view of the cable assembly in accordance with an exemplary embodiment.

FIG. 9 is a top perspective view of the cable assembly 150 in accordance with an exemplary embodiment. The cables 148 are coupled to the support frame 200 at the cable channels 226. The mating contacts 152 are coupled to the support frame 200 at the upper shelf 232 and the lower shelf 234. The ground plates 172 are coupled to the support frame 200 at the ground plate supports 240.

In an exemplary embodiment, the mating contacts 152 are arranged in an upper array 300 and a lower array 400. The mating contacts 152 in the upper array 300 may be generally referred to hereinafter as upper mating contacts 302 and the mating contacts 152 in the lower array 400 may be generally referred to hereinafter as lower mating contacts 402. The upper mating contacts 302 are configured to mate with contact pads on the upper surface of the module circuit board 128 (shown in FIG. 1) and the lower mating contacts 402 are configured to mate with contact pads on the lower surface of the module circuit board 128.

The upper mating contacts 302 may include multiple types or sets of contacts. For example, in an exemplary embodiment, the upper mating contacts 302 include high speed contacts 304, side band contacts 306, and ground contacts 308. In various embodiments, the mating contacts 152 may include power contacts. The high speed contacts 304 define first mating contacts and may be referred to hereinafter as first mating contacts 304. The side band contacts 306 define second mating contacts and may be referred to hereinafter as second mating contacts 306. The ground contacts 308 define third mating contacts and may be referred to hereinafter as third mating contacts 308. In the illustrated embodiment, the first mating contacts 304 (high speed contacts 304) are provided at the first and second sides 220, 222 and the second mating contacts 306 (side band contacts 306) are provided at the central section 230. The first mating contacts 304 may be arranged in pairs. The third mating contacts 308 (ground contacts 308) provide shielding between signal contacts, such as between pairs of the first mating contacts 304. The ground plate 172 is coupled to the third mating contacts 308. For example, ground fingers 174 extend from the ground plate 172 to electrically connect to the third mating contacts 308. In various embodiments, the ground fingers 174 may be soldered to the third mating contacts 308. In an exemplary embodiment, the ground plate 172 is electrically connected to the cable shield 192. For example, the cable shield 192 may be exposed and the ground plate 172 may be pressed against the cable shield 192 to electrically common the ground plate 172 to each of the cable shields 192.

In an exemplary embodiment, the cable assembly 150 includes an upper contact holder 310 holding the upper mating contacts 302. The upper contact holder 310 may be overmolded over the upper mating contacts 302. The upper contact holder 310 holds the relative positions of the upper mating contacts 302. The upper contact holder 310 defines the contact pitch between the upper mating contacts 302. The upper contact holder 310 is configured to be coupled to the support frame 200. The upper contact holder 310 may control horizontal and vertical positions of the upper mating contacts 302.

The first mating contacts 304 may be stamped and formed contacts. Each first mating contact 304 includes a first mating end 320 and a first terminating end 322. The first mating end 320 is cantilevered from and extends forward of the upper contact holder 310. The first mating end 320 is deflectable, such as when mated with the module circuit board 128. The first terminating end 322 extends rearward of the upper contact holder 310. The first mating end 320 includes an arm 324 and a finger 326 extending from the arm 324 to a distal end of the first mating end 320. The finger 326 may be curved inward (for example, downward) to define a mating interface 328.

The first terminating end 322 includes a terminating surface 330, such as a lower surface of the first terminating end 322. The conductors 190 of the cables 148 are configured to be terminated to the first mating contact 304 at the first terminating end 322. For example, the conductors 190 may be soldered to the first terminating end 322. The first mating contacts 304 may be held by the upper contact holder 310 such that the first terminating ends 322 are coplanar.

The second mating contacts 306 may be stamped and formed contacts. Each second mating contact 306 includes a second mating end 340 and a second terminating end 342. In various embodiments, the mating contacts 304, 306 are identical having the second mating end 340 identical to the first mating end 320 and the second terminating end 342 identical to the first terminating end 322. The second mating end 340 is cantilevered from and extends forward of the upper contact holder 310. The second mating end 340 is deflectable, such as when mated with the module circuit board 128. The second terminating end 342 extends rearward of the upper contact holder 310. The second mating end 340 includes an arm 344 and a finger 346 extending from the arm 344 to a distal end of the second mating end 340. The finger 346 may be curved inward (for example, downward) to define a mating interface 348.

The second terminating end 342 includes a terminating surface 350, such as a lower surface of the second terminating end 342. The second terminating end 342 is configured to be coupled to the corresponding jumper contact 154 at the second terminating surface 350. For example, the jumper terminating end 262 (shown in FIG. 7) of the jumper contact 154 may be soldered to the second terminating surface 350 of the second terminating end 342. In an exemplary embodiment, the jumper contacts 154 are separate and discrete from the second mating contacts 306. The second mating contacts 306 may be held by the upper contact holder 310 such that the second terminating ends 342 are coplanar, and may be coplanar with the first terminating ends 322.

The third mating contacts 306 may be stamped and formed contacts. Each third mating contact 306 includes a third mating end 360 and a third terminating end 362. In various embodiments, the mating contacts 304, 308 are identical having the third mating end 360 identical to the first mating end 320 and the third terminating end 362 identical to the first terminating end 322. The third mating end 360 is cantilevered from and extends forward of the upper contact holder 310. The third mating end 360 is deflectable, such as when mated with the module circuit board 128. The third terminating end 362 extends rearward of the upper contact holder 310. The third mating end 360 includes an arm 364 and a finger 366 extending from the arm 364 to a distal end of the third mating end 360. The finger 366 may be curved inward (for example, downward) to define a mating interface 368.

The third terminating end 362 includes a terminating surface 370, such as an upper surface of the third terminating end 362. The third terminating end 362 is configured to be coupled to the corresponding ground finger 174 at the third terminating surface 370. For example, the ground finger 174 may be soldered to the third terminating surface 370 of the third terminating end 362. The third mating contacts 306 may be held by the upper contact holder 310 such that the third terminating ends 362 are coplanar, and may be coplanar with the first terminating ends 322.

In an exemplary embodiment, the lower array 400 of the lower mating contacts 402 may be identical to the upper array 300 of upper mating contacts 302. For example, the lower mating contacts 402 may include multiple types or sets of contacts. The lower mating contacts 402 include high speed contacts, side band contacts, and ground contacts and may include power contacts. In an exemplary embodiment, the cable assembly 150 includes a lower contact holder 410 holding the lower mating contacts 402. The lower contact holder 410 may be overmolded over the lower mating contacts 402. The lower contact holder 410 holds the relative positions of the lower mating contacts 402.

When assembled, the mating contacts 152 define a mating interface for mating with the module circuit board 128. The mating contacts 152 are configured to be coupled to the upper and lower surfaces of the module circuit board 128. The first mating contacts 304 are terminated to the conductors 190 of the cables 148 to form first electrical paths between the pluggable module 106 and the electrical component 102. The high speed signals are transmitted along the first electrical paths through the first mating contacts 304 and the conductors 190. In an exemplary embodiment, the first electrical paths transmit all of the high speed signals between the pluggable module 106 and the electrical component 102. The second mating contacts 306 are terminated to the jumper contacts 154 to form second electrical paths between the pluggable module 106 and the host circuit board 140. The sideband signals are transmitted along the second electrical paths through the second mating contacts 306 and the jumper contacts 154. In an exemplary embodiment, the second electrical paths transmit all of the sideband signals between the pluggable module 106 and the host circuit board 140. The jumper contacts 154 extend from the second mating contacts 306 to the bottom of the cabled receptacle connector 112 for direction connection to the host circuit board 140. The jumper contacts 154 are configured to terminate directly to the host circuit board 140 within a footprint of the receptacle housing 160.

Figure 10:
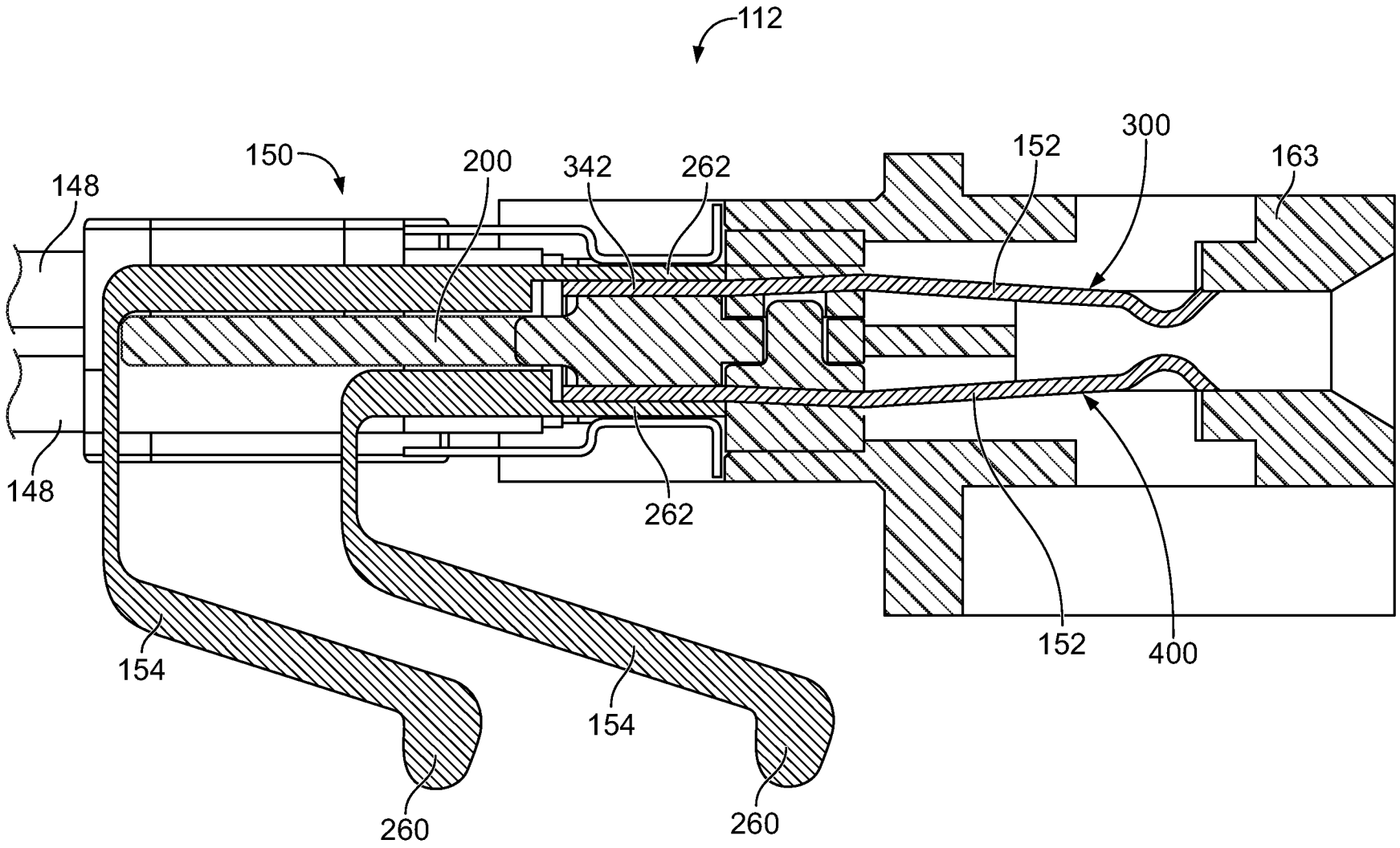
FIG. 10 is a cross-sectional view of a portion of the cable receptacle connector in accordance with an exemplary embodiment.

FIG. 10 is a cross-sectional view of a portion of the cable receptacle connector 112 in accordance with an exemplary embodiment. FIG. 10 shows the cable assembly 150 loaded into the front housing 163. The support frame 200 supports the cables 148, the jumper contacts 154 and the mating contacts 152. The cables 148 are configured to be coupled to corresponding mating contacts 152 of the upper array 300 and the lower array 400. The jumper contacts 154 are configured to be coupled to corresponding mating contacts 152 of the upper array 300 and the lower array 400. FIG. 10 illustrates the jumper contacts 154 as separate and discrete from the mating contacts 152. The jumper terminating ends 262 are coupled to the terminating ends 342 of the mating contacts 152. For example, the jumper terminating ends 262 are soldered to the terminating ends 342.

The jumper mounting ends 260 extend to the bottom of the cable receptacle connector 112. Both the upper set of jumper contacts 154 and the lower set of jumper contacts 154 extend to the bottom. The jumper mounting ends 260 are arranged in two rows; however, the jumper mounting ends 260 may be arranged in greater or fewer rows in alternative embodiments.

Figure 11:
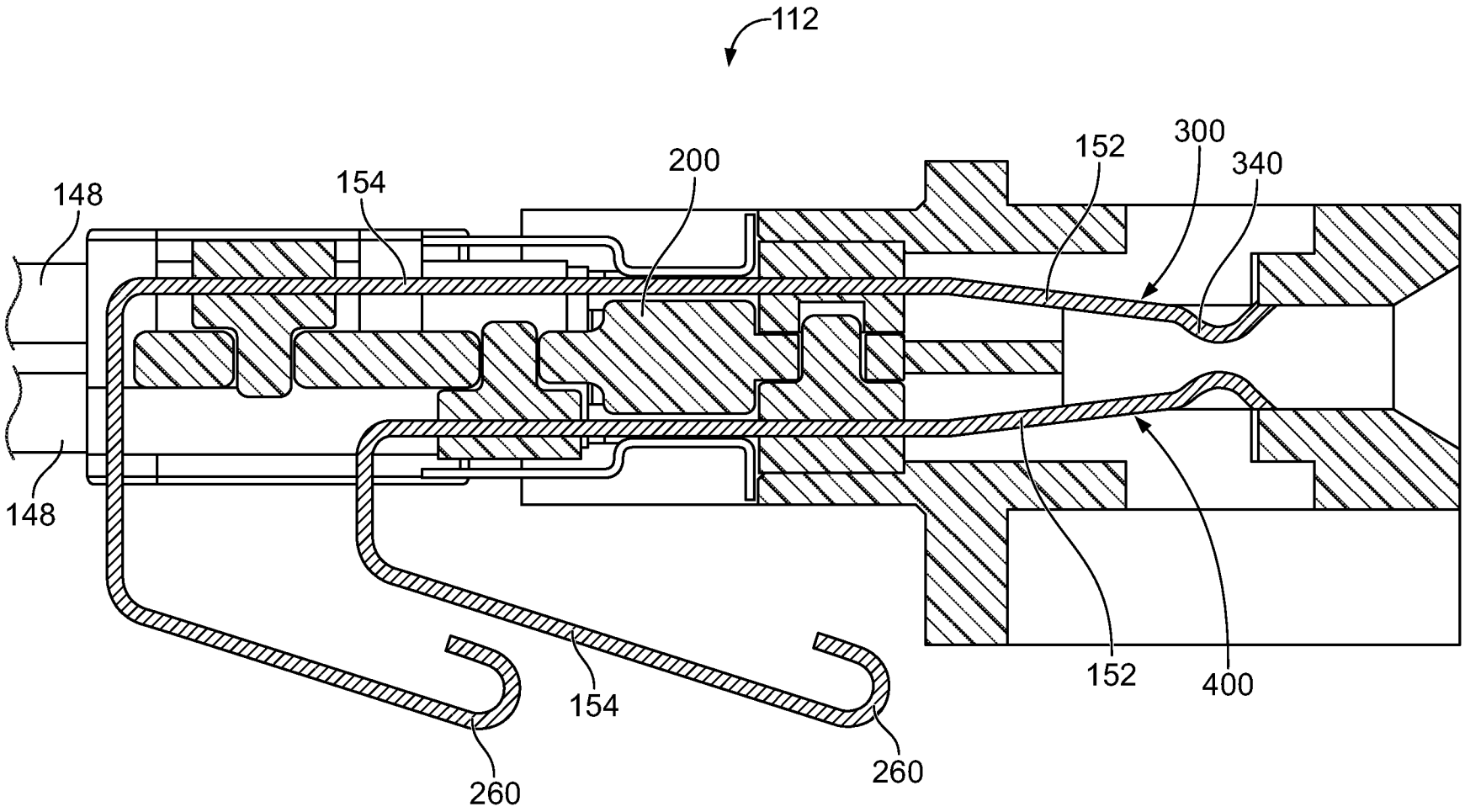
FIG. 11 is a cross-sectional view of a portion of the cable receptacle connector in accordance with an exemplary embodiment.

FIG. 11 is a cross-sectional view of a portion of the cable receptacle connector 112 in accordance with an exemplary embodiment. The support frame 200 supports the cables 148, the jumper contacts 154 and the mating contacts 152. The cables 148 are configured to be coupled to corresponding mating contacts 152 of the upper array 300 and the lower array 400. The jumper contacts 154 are electrically connected to corresponding mating contacts 152 of the upper array 300 and the lower array 400. In the illustrated embodiment, the jumper contacts 154 are integral with the mating contacts 152. The mating ends 340 are provided at one end of the mating contacts 152 and the jumper contacts 154 are provided at the opposite end of the mating contacts 152. The jumper contacts 154 are stamped and formed with the mating ends 340 of the mating contacts 152. As such, the sideband signals may be transmitted from the mating ends 340 to the jumper mounting ends 260 without passing through an interface.

Figure 12:
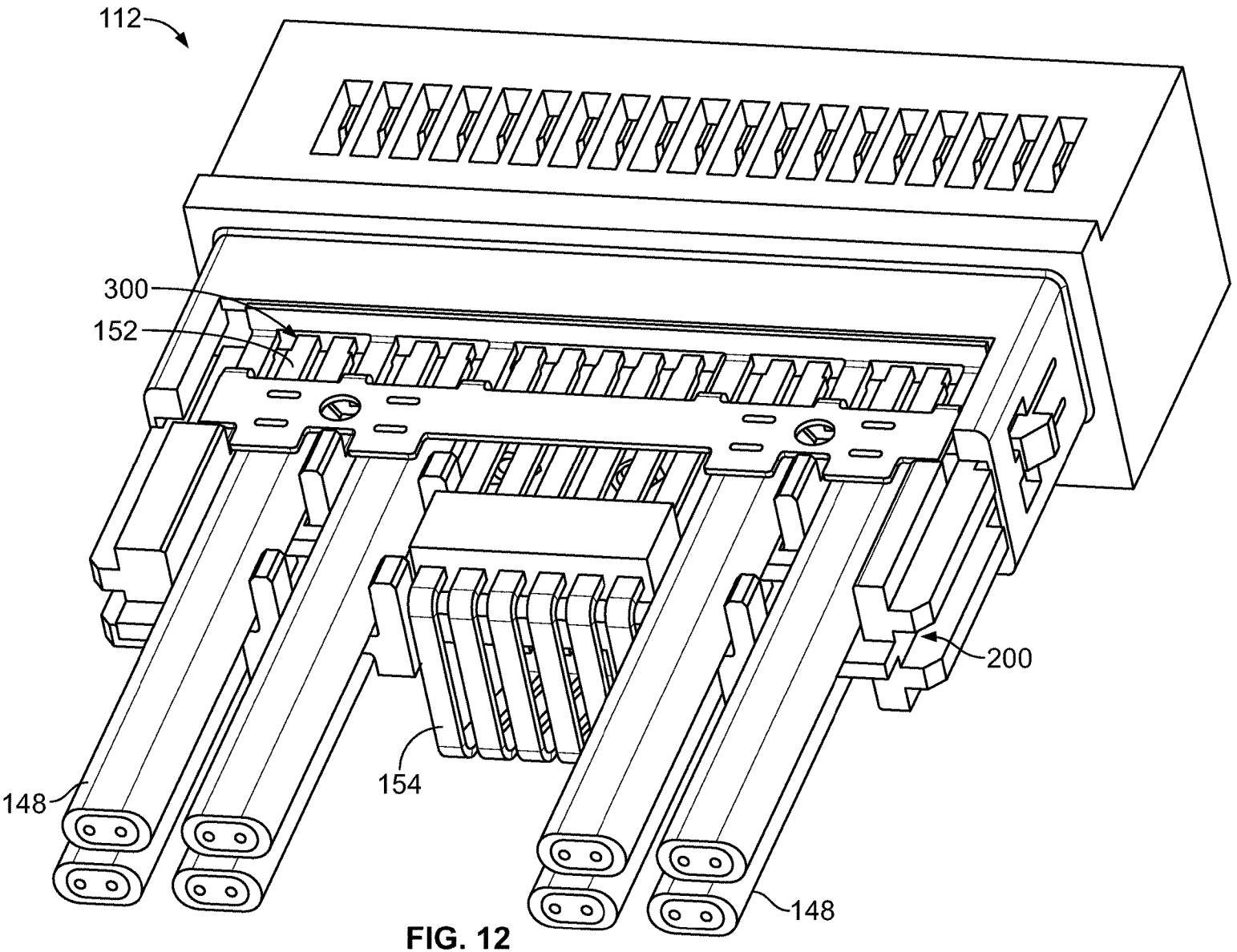
FIG. 12 is a rear, top perspective view of a portion of the cable receptacle connector in accordance with an exemplary embodiment.
Figure 13:
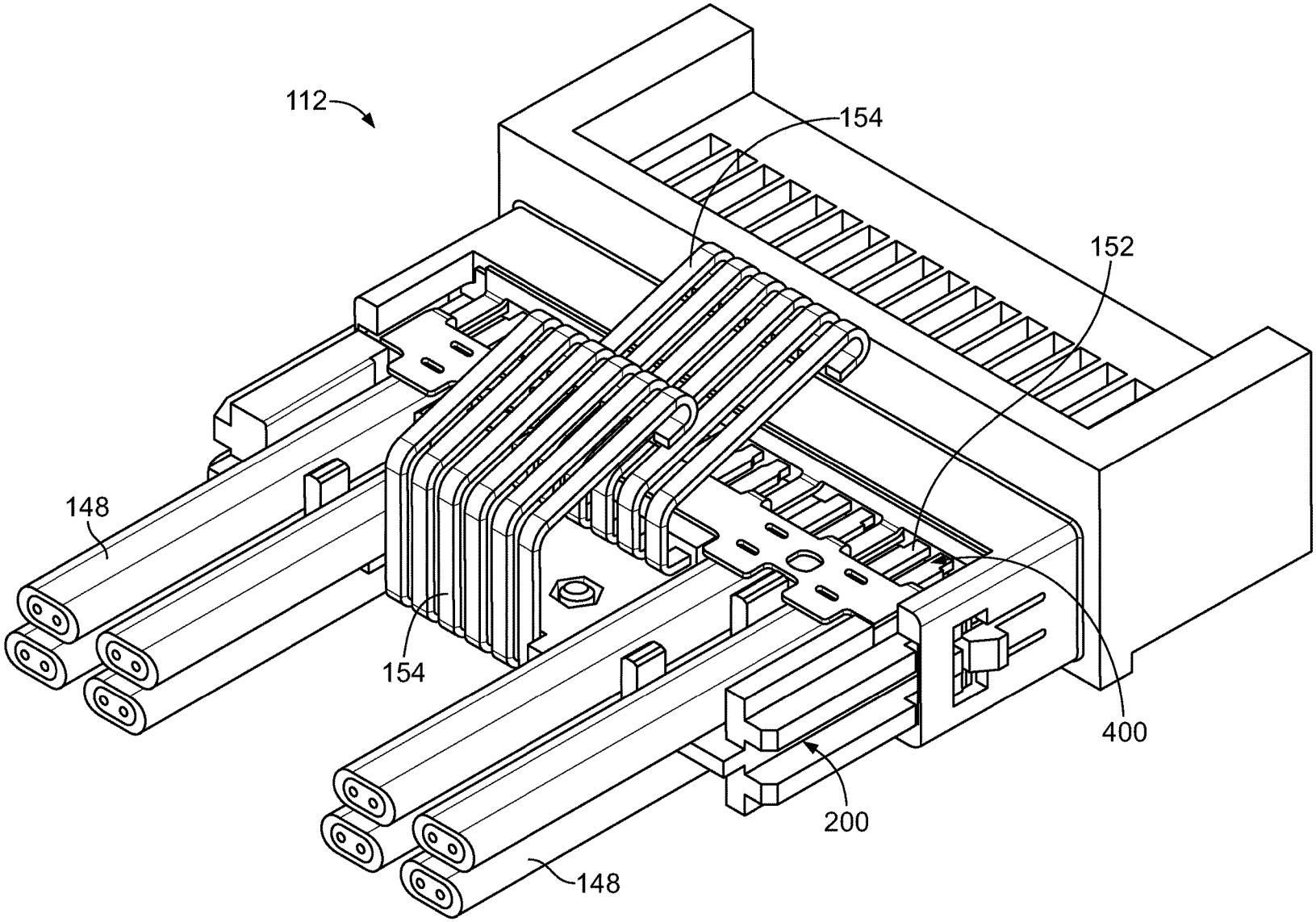
FIG. 13 is a rear, bottom perspective view of a portion of the cable receptacle connector in accordance with an exemplary embodiment.

FIG. 12 is a rear, top perspective view of a portion of the cable receptacle connector 112 in accordance with an exemplary embodiment. FIG. 13 is a rear, bottom perspective view of a portion of the cable receptacle connector 112 in accordance with an exemplary embodiment. The support frame 200 supports the cables 148, the jumper contacts 154 and the mating contacts 152. The cables 148 are configured to be coupled to corresponding mating contacts 152 of the upper array 300 and the lower array 400. The jumper contacts 154 are electrically connected to corresponding mating contacts 152 of the upper array 300 and the lower array 400.

It is understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A cabled receptacle connector for a receptacle assembly comprising:

a receptacle housing having a cavity extending between a front and a rear of the receptacle housing, the receptacle housing having a mating slot at the front configured to receive a pluggable module removably received in a receptacle cage of the receptacle assembly; and a cable assembly received in the cavity at the rear of the receptacle housing, the cable assembly including a support frame having a platform supporting first mating contacts and second mating contacts, the first mating contacts having first mating ends extending into the mating slot for electrical connection with the pluggable module, the second mating contacts having second mating ends extending into the mating slot for electrical connection with the pluggable module, the cable assembly including cables coupled to the platform, the cables having conductors electrically connected to first terminating ends of the first mating contacts, the cables extending from the cable receptacle connector, the cable assembly including jumper contacts coupled to the support frame, the jumper contacts being electrically connected to the second mating contacts, the jumper contacts including mounting ends configured to be mounted to a host circuit board;

wherein first electrical paths are defined between the pluggable module and an electrical component remote from the receptacle housing by the first mating contacts and the cable conductors, and wherein second electrical paths are defined between the pluggable module and the host circuit board by the second mating contacts and the jumper contacts.

2. The cabled receptacle connector of claim 1, wherein the receptacle housing has a bottom, the mounting ends of the jumper contacts located exterior of the receptacle housing for interfacing with the host circuit board.

3. The cabled receptacle connector of claim 1, wherein the mounting ends of the jumper contacts define a separable interface with the host circuit board.

4. The cabled receptacle connector of claim 1, wherein the jumper contacts are integral with the second mating contacts.

5. The cabled receptacle connector of claim 1, wherein the jumper contacts are separate and discrete from the second mating contacts, the second mating contacts including second terminating ends, the second terminating ends being coupled to jumper terminating ends of the jumper contacts.

6. The cabled receptacle connector of claim 1, wherein the jumper contacts include jumper terminating ends, the second mating contacts having second terminating ends, the jumper terminating ends being coplanar with the conductors, the second terminating ends being coplanar with the first terminating ends for termination to the jumper terminating ends and the conductors, respectively.

7. The cabled receptacle connector of claim 1, wherein the jumper contacts include jumper terminating ends, the jumper contacts include a first set of jumper contacts and a second set of jumper contacts, the jumper terminating ends of the first set of jumper contacts located along an upper surface of the platform, the jumper terminating ends of the second set of jumper contacts located along a lower surface of the platform.

8. The cabled receptacle connector of claim 1, wherein the jumper contacts include a first set of jumper contacts and a second set of jumper contacts, the mounting ends of the first set of jumper contacts being arranged in a first row, the mounting ends of the second set of jumper contacts being arranged in a second row offset from the first row.

9. The cabled receptacle connector of claim 1, wherein the support frame includes an upper surface and a lower surface, an upper array of the first mating contacts and an upper array of the second mating contacts being provided at the upper surface, a lower array of the first mating contacts and a lower array of the second mating contacts being provided at the lower surface, the first mating ends of the upper array of the first mating contacts located above the mating slot, the first mating ends of the upper array of the second mating contacts located above the mating slot, the first mating ends of the lower array of the first mating contacts located below the mating slot, the first mating ends of the lower array of the second mating contacts located below the mating slot.

10. The cabled receptacle connector of claim 1, wherein the first mating contacts define high speed contacts for the cable assembly and the second mating contacts define sideband contacts for the cable assembly.

11. The cabled receptacle connector of claim 1, wherein the cable receptacle connector is configured to transmit high speed data signals and sideband signals, the first electrical paths transmitting all of the high speed signals between the pluggable module and an electrical component remote from the receptacle housing, the second electrical paths transmitting all of the sideband signals between the pluggable module and the host circuit board.

12. The cabled receptacle connector of claim 1, wherein the jumper contacts terminate directly to the host circuit board within a footprint of the receptacle housing.

13. The cabled receptacle connector of claim 1, further comprising a contact holder coupled to the first mating contacts and the second mating contacts, the contact holder holding relative positions of each of the first mating contacts and the second mating contacts.

14. The cabled receptacle connector of claim 1, further comprising ground contacts coupled to the platform, the ground contacts having ground mating ends extending into the mating slot for electrical connection with the pluggable module, the cable receptacle connector further comprising a ground plate having ground fingers extending therefrom, the ground fingers being electrically connected to corresponding ground contacts, the ground plate electrically commoning the ground contacts coupled to the ground fingers.

15. A cabled receptacle connector for a receptacle assembly comprising:

a receptacle housing having a top and a bottom, the receptacle housing having a cavity between the top and the bottom, the receptacle housing having a mating slot at a front configured to receive a pluggable module removably received in a receptacle cage of the receptacle assembly above a host circuit board; and a cable assembly received in the cavity at the rear of the receptacle housing, the cable assembly including cables having conductors, the cables extending rearward from the cable receptacle connector, the cable assembly including a support frame having a platform supporting first mating contacts and second mating contacts, the first mating contacts having first mating ends and first terminating ends, the first mating ends extending into the mating slot for electrical connection with the pluggable module, the first terminating ends extending along the platform for electrical connection with the conductors of the cables, the second mating contacts having second mating ends extending into the mating slot for electrical connection with the pluggable module, the second mating contacts having jumper contacts opposite the mating ends, the jumper contacts coupled to the support frame and extending to the bottom of the receptacle housing for electrical connection with the host circuit board;

wherein first electrical paths are defined between the pluggable module and an electrical component remote from the receptacle housing by the first mating contacts and the cable conductors, and wherein second electrical paths are defined between the pluggable module and the host circuit board by the second mating contacts and the jumper contacts.

16. The cabled receptacle connector of claim 15, wherein the receptacle housing has a bottom, the mounting ends of the jumper contacts located exterior of the receptacle housing for interfacing with the host circuit board at a separable interface with the host circuit board.

17. The cabled receptacle connector of claim 15, wherein the jumper contacts are integral with the second mating contacts.

18. The cabled receptacle connector of claim 15, wherein the support frame includes an upper surface and a lower surface, an upper array of the first mating contacts and an upper array of the second mating contacts being provided at the upper surface, a lower array of the first mating contacts and a lower array of the second mating contacts being provided at the lower surface, the first mating ends of the upper array of the first mating contacts located above the mating slot, the first mating ends of the upper array of the second mating contacts located above the mating slot, the first mating ends of the lower array of the first mating contacts located below the mating slot, the first mating ends of the lower array of the second mating contacts located below the mating slot.

19. A receptacle assembly comprising:

a receptacle cage having a plurality of walls defining a module channel extending between a front and a rear of the receptacle cage, the plurality of walls including a top wall, a first side wall extending from the top wall to a bottom of the receptacle cage and a second side wall extending from the top wall to the bottom, wherein the module channel is open at the front to receive a pluggable module therein, the module channel being open at the rear; and a cabled receptacle connector received in the module channel at the rear of the receptacle cage, the cabled receptacle connector comprising:

a receptacle housing coupled to the receptacle cage, the receptacle housing having a cavity extending between a front and a rear of the receptacle housing, the receptacle housing having a mating slot at the front configured to receive a pluggable module removably received in a receptacle cage of the receptacle assembly; and a cable assembly received in the cavity at the rear of the receptacle housing, the cable assembly including a support frame having a platform supporting first mating contacts and second mating contacts, the first mating contacts having first mating ends extending into the mating slot for electrical connection with the pluggable module, the second mating contacts having second mating ends extending into the mating slot for electrical connection with the pluggable module, the cable assembly including cables coupled to the platform, the cables having conductors electrically connected to first terminating ends of the first mating contacts, the cables extending from the cable receptacle connector rearward of the receptacle cage, the cable assembly including jumper contacts coupled to the support frame, the jumper contacts being electrically connected to the second mating contacts, the jumper contacts including mounting ends configured to be mounted to a host circuit board;

wherein first electrical paths are defined between the pluggable module and an electrical component remote from the receptacle housing by the first mating contacts and the cable conductors, and wherein second electrical paths are defined between the pluggable module and the host circuit board by the second mating contacts and the jumper contacts.

20. The receptacle assembly of claim 19, wherein the receptacle housing has a bottom, the mounting ends of the jumper contacts located exterior of the receptacle housing at the bottom for interfacing with the host circuit board at a separable interface with the host circuit board.

* * * * *